US007382345B2

(12) United States Patent
Hong

(10) Patent No.: US 7,382,345 B2
(45) Date of Patent: Jun. 3, 2008

(54) APPARATUS AND METHOD FOR DRIVING LIQUID CRYSTAL DISPLAY DEVICE

(75) Inventor: Jin Cheol Hong, Gyeongsangbuk-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 586 days.

(21) Appl. No.: 11/000,193

(22) Filed: Dec. 1, 2004

(65) Prior Publication Data

US 2005/0140619 A1 Jun. 30, 2005

(30) Foreign Application Priority Data

Dec. 11, 2003 (KR) ..... 10-2003-0090300

(51) Int. Cl.
*G09G 3/36* (2006.01)
*G09G 5/00* (2006.01)

(52) U.S. Cl. ..... 345/99; 345/98; 345/100; 345/214

(58) Field of Classification Search ..... 345/87, 345/98, 99, 100, 211, 212, 213, 214
See application file for complete search history.

(56) References Cited

U.S. PATENT DOCUMENTS 5,675,355 A * 10/1997 Chiu et al. ..... 345/99
5,859,669 A * 1/1999 Prentice ..... 348/469
6,211,850 B1 * 4/2001 Komatsu ..... 345/87
6,335,718 B1 * 1/2002 Hong et al. ..... 345/98
6,611,247 B1 * 8/2003 Chang et al. ..... 345/99
2005/0128175 A1 * 6/2005 Hong ..... 345/100

FOREIGN PATENT DOCUMENTS

| | | |
|---|---|---|
| JP | 9-159993 | 6/1997 |
| JP | 2000-207077 | 7/2000 |
| WO | WO 03/094362 A2 | 11/2003 |

* cited by examiner

*Primary Examiner*—My-Chau T. Tran
(74) *Attorney, Agent, or Firm*—Morgan, Lewis & Bockius LLP

(57) ABSTRACT

A driving apparatus for a liquid crystal display device having a plurality of data lines includes a data integrated circuit, a timing controller connected to the data integrated circuit, an encoder provided at the timing controller, the encoder determining whether a data for a current line is identical to a data for a previous line and generating a line control signal based on the determination whether the current line data is identical to the previous line data, and a decoder provided at the data integrated circuit, the decoder receiving the line control signal from the encoder.

16 Claims, 6 Drawing Sheets

APPARATUS AND METHOD FOR DRIVING LIQUID CRYSTAL DISPLAY DEVICE

The present application claims the benefit of Korean Patent Application No. P2003-90300 filed in Korea on Dec. 11, 2003, which is hereby incorporated by reference.

BACKGROUND OF THE INVENTION

1. Field of the Invention

The present invention relates to a liquid crystal display device, and more particularly, to an apparatus and a method for driving a liquid crystal display device that compares a data for each line, to thereby minimize a data transition amount and improve an electromagnetic interference (EMI) characteristic.

2. Discussion of the Related Art

In general, a liquid crystal display (LCD) device controls light transmittance of liquid crystal cells in accordance with data signals applied thereto, to thereby display an image. In particular, an active matrix type LCD device includes a switching device for each cell and has various applications, such as a monitor for a computer, an office equipment, and a cellular phone, because of their high quality image, lightness, thin thickness, compact size, and low power consumption. A thin film transistor (TFT) is generally employed as the switching device for the active matrix type LCD device.

FIG. 1 is a schematic block diagram showing a driving apparatus for a liquid crystal display device according to the related art. In FIG. 1, an LCD driving apparatus includes a liquid crystal display panel 2 having liquid crystal cells Clc arranged in a matrix-like manner at intersections between data lines DL and gate lines GL, a data driver 4 for applying data signals to the data lines DL, a gate driver 6 for applying gate signals to the gate lines GL, and a timing controller 8 for controlling the data driver 4 and the gate driver 6 using signals applied from a system 10.

In addition, a thin film transistor TFT is provided at each of the liquid crystal cells Clc. The thin film transistor TFT applies a data signal from a respective one of the data lines DL to the liquid crystal cell Clc in response to a scanning signal from a respective one of the gate lines GL. A storage capacitor Cst also is provided at each of the liquid crystal cells Clc. The storage capacitor Cst maintains a voltage of the liquid crystal cell Clc.

Further, the data driver 4 converts digital video data R, G and B into analog gamma voltages, i.e., data signals, corresponding to gray level values in response to a data control signal DCS from the timing controller 8, and applies the analog gamma voltages to the data lines DL. The gate driver 6 sequentially applies a scanning pulse to the gate lines GL in response to a gate control signal GCS from the timing controller 8, to thereby select horizontal lines of the liquid crystal display panel 2 to be supplied with the data signals.

The system 10 applies vertical/horizontal synchronizing signals V and H, a clock signal DCLK and a data enable signal DE to the timing controller 8. Further, the system 10 compresses a parallel digital data into a serial data using a low voltage differential signal interface, and applies the compressed data LVDS to the timing controller 8.

Moreover, the timing controller 8 generates the gate control signal GCS and the data control signal GCS using the vertical/horizontal synchronizing signals V and H, the clock signal DCLK and the data enable signal DE inputted from the system 10. The timing controller 8 also restores the compressed data LVDS from the system 10 into a parallel data and supplies the restored data data to the data driver 4.

For example, for each pixel, the timing controller 8 applies 18 bit data, each of R, G and B data having 6 bits, to the data driver 4 using 18 data lines. As shown in Table 1, if all of the current pixel data Pn have bits of '0' while all of the next pixel data Pn+1 have bits of '1,' such a transition for all bits causes a high EMI.

TABLE 1

| | R[0:5] | G[0:5] | B[0:5] |
|---|---|---|---|
| Pn | 000000 | 000000 | 000000 |
| Pn + 1 | 111111 | 111111 | 111111 |

In particular, such a phenomenon becomes more serious as a resolution and a dimension (i.e., inch) of the liquid crystal display panel 2 become larger. For instance, if 24 bits are used for data for one pixel where each R, G and B data having 8 bits, then the number of bits transferred from the timing controller 8 into the data driver 4 is increased to cause an even higher EMI. Accordingly, a serious EMI occurs due to a transition of the data.

FIG. 2 is a schematic block diagram showing another driving apparatus for a liquid crystal display device according to the related art. In particular, the driving apparatus shown in FIG. 2 has been suggested to reduce a high EMI as discussed with respect to the apparatus shown in FIG. 1. As shown in FIG. 2, an LCD driving apparatus includes a liquid crystal display panel 2 having liquid crystal cells Clc arranged in a matrix-like manner at intersections between data lines DL and gate lines GL, a data driver 4 for applying data signals to the data lines DL, a gate driver 6 for applying gate signals to the gate lines GL, and a timing controller 12 for controlling the data driver 4 and the gate driver 6 using signals applied from a system 10.

The timing controller 12 generates a gate control signal GCS and a data control signal GCS for controlling the gate driver 6 and the data driver 4, respectively, using vertical/horizontal synchronizing signals V and H, a clock signal DCLK and a data enable signal DE inputted from the system 10. Although not shown, the gate control signal GCS includes a gate start pulse GSP, a gate shift clock GSC and a gate output enable signal GOE, and the data control signal DCS includes a source start pulse SSP, a source shift clock SSC, a source output enable signal SOE and a polarity control signal POL. The timing controller 12 also compressed data LVDS from the system 10 into a parallel data and supplies the restored data data to the data driver 4. The timing controller 12 further includes a mode controller 14 for minimizing a transition frequency of data.

In particular, the mode controller 14 compares data transition states between the next pixel data and the current pixel data. Thus, the mode controller 14 compares each bit of the next pixel data Pn+1 with each bit of the current pixel data Pn to detect a bit transition amount such as "0→1" or "1→0", and makes an inverted or non-inverted output of the data in response to the detected bit transition amount.

In addition, the mode controller 14 counts bit transition amounts between the current pixel data Pn and the next pixel data Pn+1, and checks whether or not the counted transition amount exceeds a critical value. For instance, the critical value could be 9, a half of an 18 bit data. Then, as shown in Table 2, whenever the data transition amount exceeds the critical value, the mode controller 14 inverts a logical value of a mode control signal REV and inverts the next pixel data to be supplied.

TABLE 2

| | R[0:5] | G[0:5] | B[0:5] | Bit transition amount | REV |
|---|---|---|---|---|---|
| Pn | 000000 | 000000 | 000000 | 0 | low |
| Pn + 1 | 111111 | 111111 | 111111 | 16 | high |
| Pn + 1' | 000000 | 000000 | 000000 | n/a | n/a |

For instance, if all of the current pixel data Pn have bits of 'O' while all of the next pixel data Pn+1 have bits of '1,' the mode controller 14 counts the bit transition amount to be 16. Since the bit transition amount is more than the critical value of 9, the mode control signal REV is inverted and an inverted next pixel data Pn+1' having "000000 000000 000000" is generated and applied to the data driver 4 as the next frame data. That is, all bits of the next pixel data Pn+1 are inverted in response to the mode control signal REV, thereby sending the inverted next pixel data Pn+1' which has the same bits as the previous frame data to the data driver 4.

FIG. 3 is a block diagram showing a data integrated circuit according to the related art. As shown in FIG. 3, the data driver 4 (shown in FIG. 2) includes a data integrated circuit (IC) having a data restoration part 18, a shift register part 20, a latch part 22, a digital to analog converter (DAC) part 24 and an output buffer part 26. The data restoration part 18 inverts or non-inverts a data in response to the mode control signal REV prior to applying the data to the latch part 22. In particular, when the mode control signal REV is inverted, the data restoration part 18 inverts all bits of a data supplied thereto to generate a restored data and applies the restored data to the latch part 22. When the mode control signal REV is not inverted, the data restoration part 18 relays a data supplied thereto to the latch part 22.

In addition, the shift register part 20 includes a plurality of shift registers to sequentially shift the source start pulse SSP from the timing controller 12 in response to the source shift clock SSC, thereby outputting a sampling signal. The latch part 22 then sequentially samples a data data supplied from the data restoration part 18 in response to the sampling signal from the shift register part 20 and then latches it. In particular, the latch part 22 has i latches (i being an integer), and each of the latches has a size corresponding to the bit number of data (e.g., 6 bits or 8 bits). Further, the latch part 22 simultaneously outputs the latched i data in response to the source output enable signal SOE supplied from the timing controller 12.

The DAC part 24 converts the latched data received from the latch part 22 into positive and/or negative data signals. In particular, the DAC part 24 receives a plurality of gamma voltages from a gamma voltage generator (not shown) and converts the latched data into positive and/or negative data signals in response to the polarity control signal POL. Then, the DAC part 24 outputs the converted data to the output buffer part 26. The output buffer part 26 buffers the converted data and applies the buffered data to the data lines DL.

Although in comparison to the driving apparatus shown in FIG. 1, the driving apparatus shown in FIG. 2 compares the current pixel data with the next pixel data to reduce a generation of high EMI, the driving apparatus shown in FIG. 2 has a limit in reducing the bit transition frequency of data because the apparatus only compares the current pixel data and the next pixel data with each other.

SUMMARY OF THE INVENTION

Accordingly, the present invention is directed to an apparatus and method for driving a liquid crystal display device that substantially obviate one or more of the problems due to limitations and disadvantages of the related art.

An object of the present invention is to provide an apparatus and method for driving a liquid crystal display device that compares a data for each line to thereby minimize a data transition amount and improve an electromagnetic interference (EMI) characteristic.

Another object of the present invention to provide an apparatus and method for driving a liquid crystal display device that does not apply a data signal to a data driver if a current line data is determined to be identical to a previous line data, thereby reducing signal transmission and efficiently reducing an EMI.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described herein, a driving apparatus for a liquid crystal display device having a plurality of data lines includes a data integrated circuit, a timing controller connected to the data integrated circuit, an encoder provided at the timing controller, the encoder determining whether a data for a current line is identical to a data for a previous line and generating a line control signal based on the determination whether the current line data is identical to the previous line data, and a decoder provided at the data integrated circuit, the decoder receiving the line control signal from the encoder.

In another aspect, a method of driving a liquid crystal display device having a plurality of data lines includes determining whether a data for a current horizontal line is identical to a data for a previous horizontal line, and preventing a data signal and a source shift clock from being applied from a timing controller to a data driver when the current line data is determined to be identical to the previous line data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments, examples of which are illustrated in the accompanying drawings.

Figure 1:
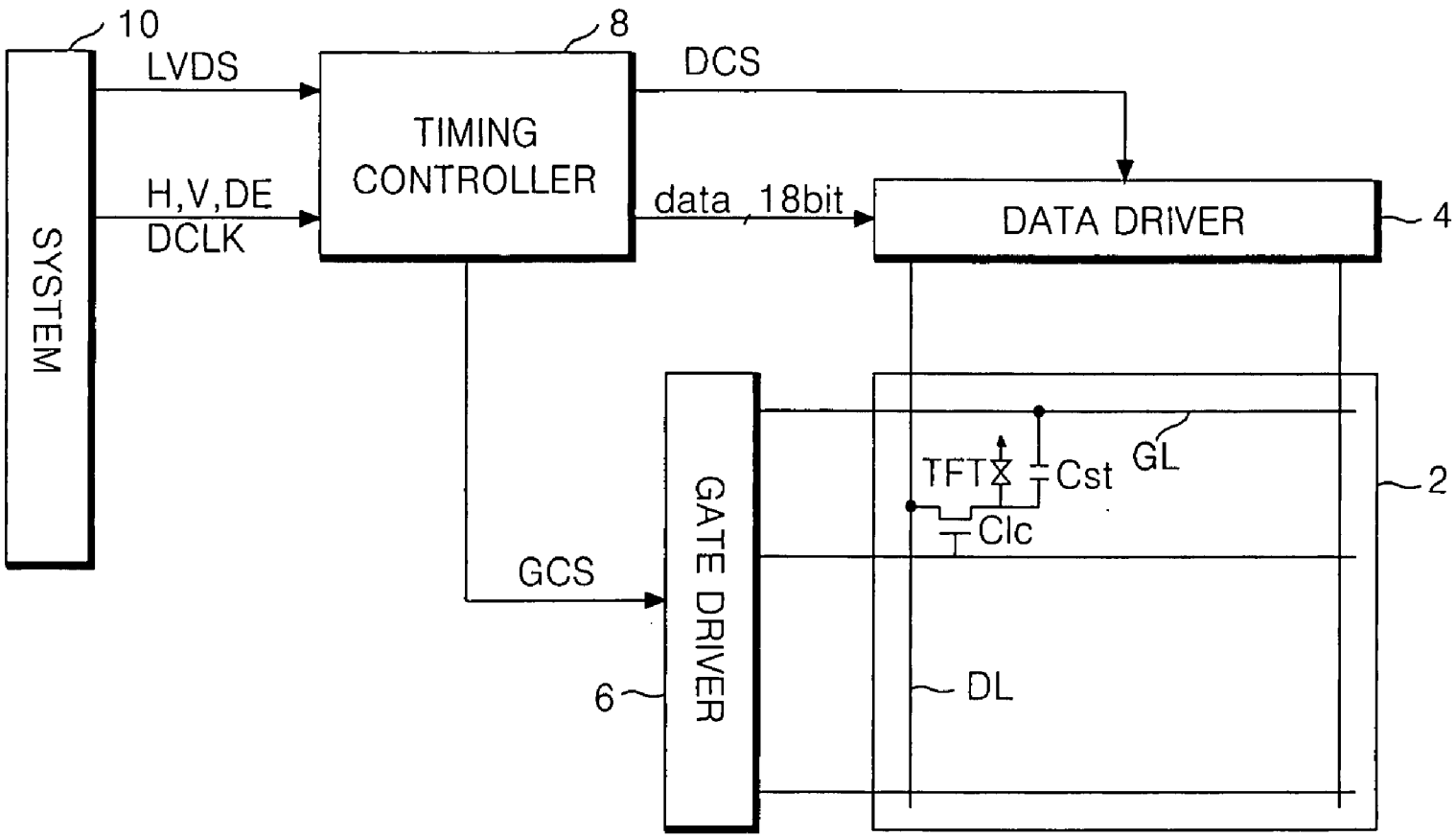
FIG. 1 RELATED ART
FIG. 1 is a schematic block diagram showing a driving apparatus for a liquid crystal display device according to the related art.
Figure 2:
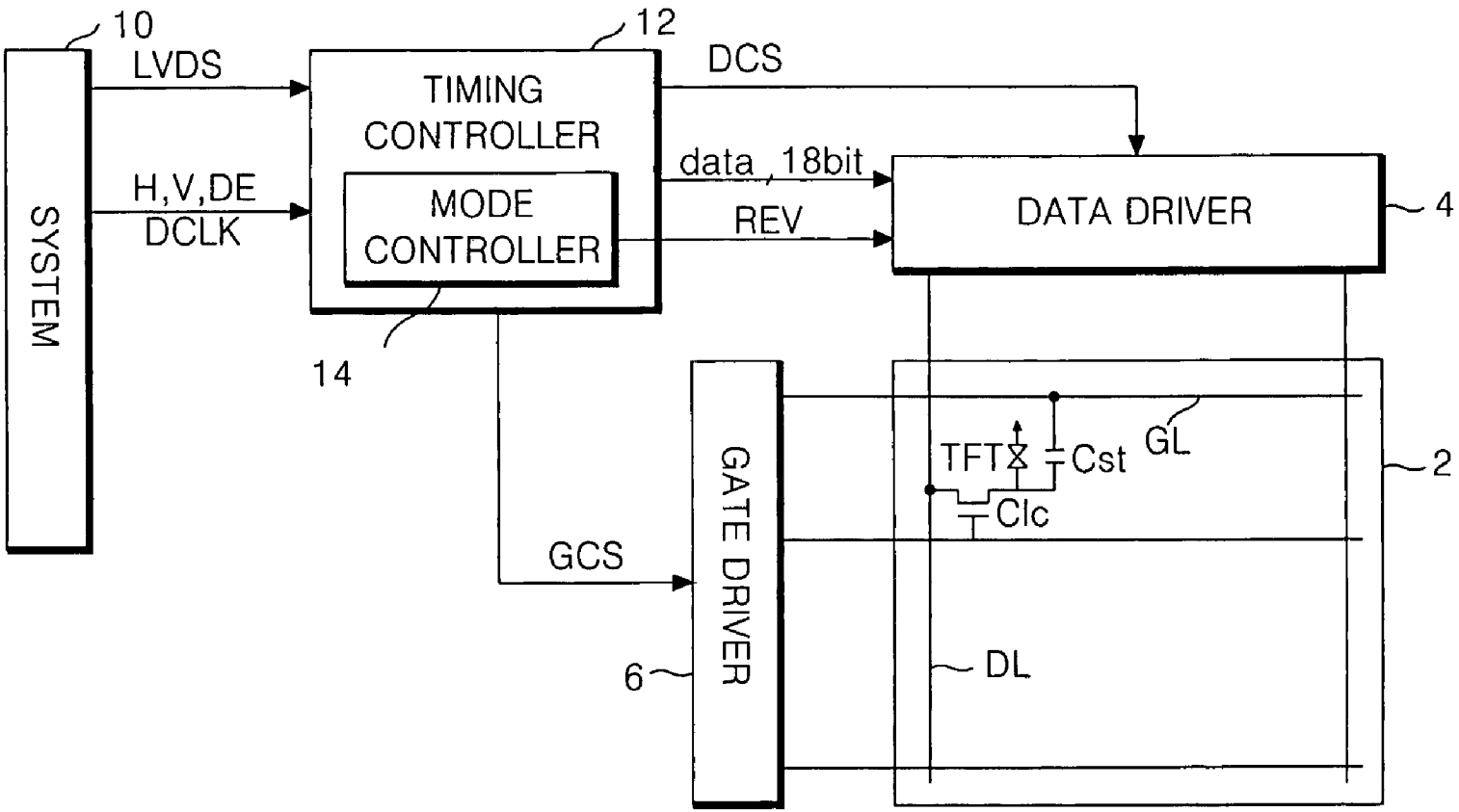
FIG. 2 RELATED ART
FIG. 2 is a schematic block diagram showing another driving apparatus for a liquid crystal display device according to the related art.
Figure 3:
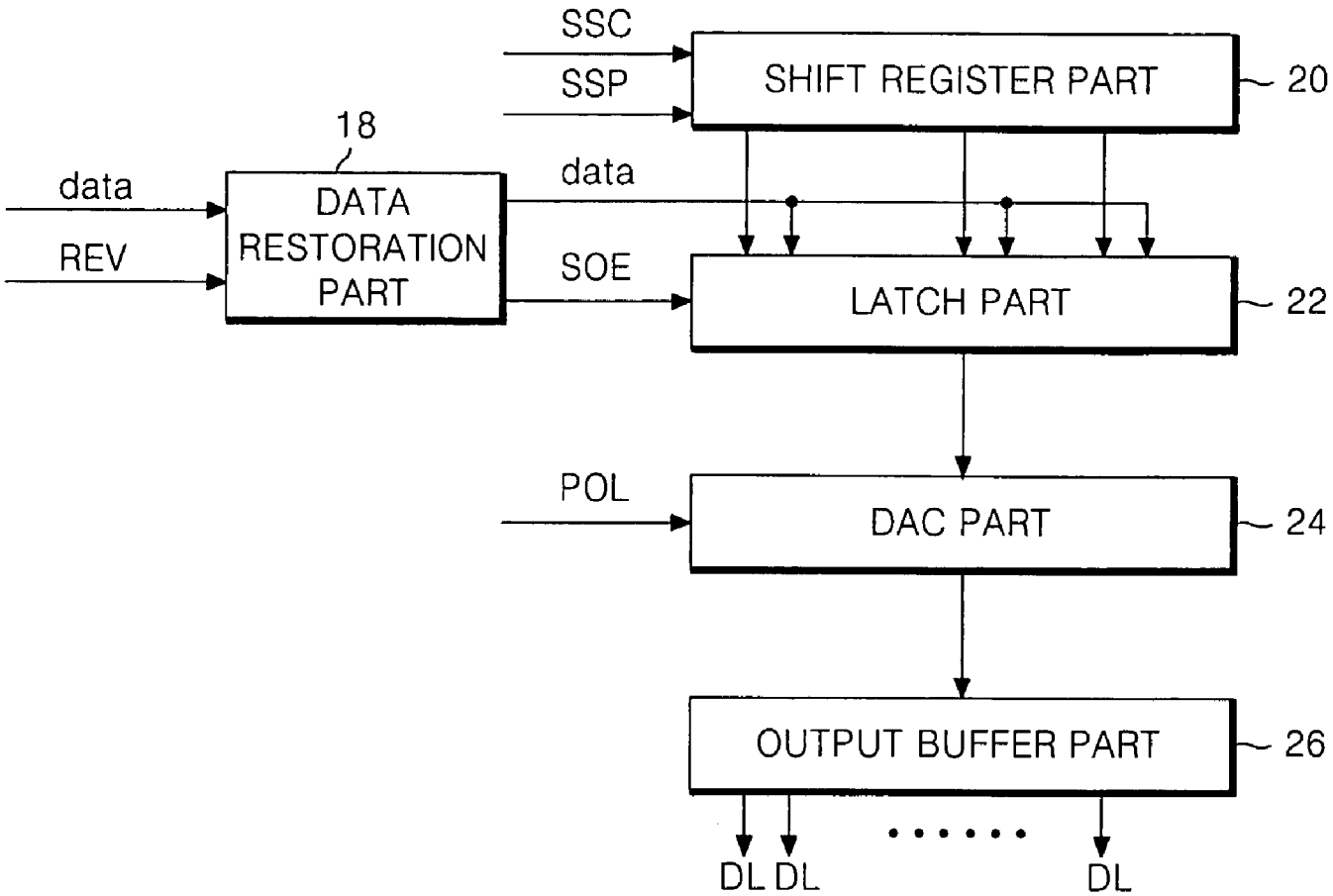
FIG. 3 RELATED ART
FIG. 3 is a block diagram showing a data integrated circuit according to the related art.
Figure 4:
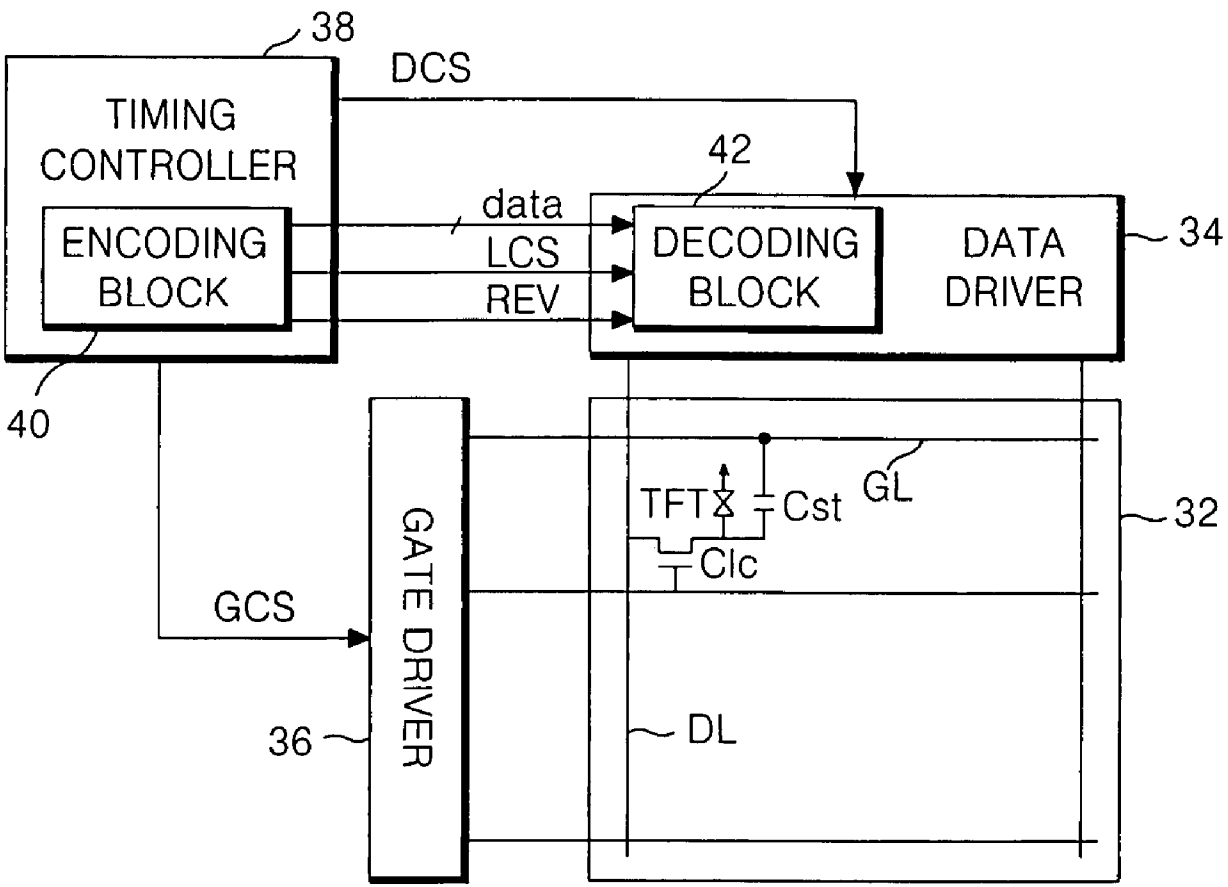
FIG. 4 is a schematic block diagram showing a driving apparatus for a liquid crystal display device according to an embodiment of the present invention.

FIG. 4 is a schematic block diagram showing a driving apparatus for a liquid crystal display device according to an embodiment of the present invention. In FIG. 4, a driving apparatus for liquid crystal display device includes a liquid crystal display panel 32 having liquid crystal cells Clc arranged in a matrix-like manner at intersections between data lines DL and gate lines GL, a data driver 34 for applying data signals to the data lines DL, a gate driver 36 for applying gate signals to the gate lines GL, and a timing controller 38 for controlling the data driver 34 and the gate driver 36.

In addition, a thin film transistor TFT is provided at each of the liquid crystal cells Clc of the liquid crystal display panel 32. The thin film transistor TFT applies a data signal from a respective one of the data lines DL to the liquid crystal cell Clc in response to a scanning signal from a respective one of the gate lines GL. A storage capacitor Cst also is provided at each of the liquid crystal cells Clc. The storage capacitor Cst maintains a voltage of the liquid crystal cell Clc.

The gate driver 36 receives a gate control signal GCS from the timing controller 38, and sequentially applies a scanning pulse to the gate lines GL in response to the gate control signal GCS. As a result, the gate lines GL may be sequentially driven to allow the data signal be applied to the liquid crystal cells Clc row-by-row.

Further, the data driver 34 may receive a data signal data, a data control signal DCS, a mode control signal REV, and a line control signal LCS from the timing controller 38. The data signal data may be digital video data supplied to the timing controller 38 from an exterior source (not shown). In addition, the data driver 34 may include a plurality of data ICs and each of the data ICs has a decoding block 42. The decoding block 42 selectively inverts the data signal data received from the timing controller 38 in response to the mode control signal REV before applying the data signal data to the data IC. Further, the decoding block 42 determines whether or not the data signal data is to be supplied in response to the line control signal LCS. Further, the data driver 34 may convert the data signal data into analog gamma voltages corresponding to gray level values in response to the data control signal DCS using the data ICs. The data driver 34 may subsequently apply the analog gamma voltages to the data lines DL.

Moreover, the timing controller 38 generates the gate control signal GCS and the data control signal GCS using vertical/horizontal synchronizing signals V and H, a clock signal DCLK and a data enable signal DE supplied from an exterior system (not shown). The timing controller 38 also includes an encoding block 40. In particular, the encoding block 40 compares the previous pixel data with the current pixel data and compares the pixel data at the current line with the pixel data at the previous line with respect to a data supplied from the external system, to thereby selectively change the pixel data and minimize a bit transition amount.

Figure 5:
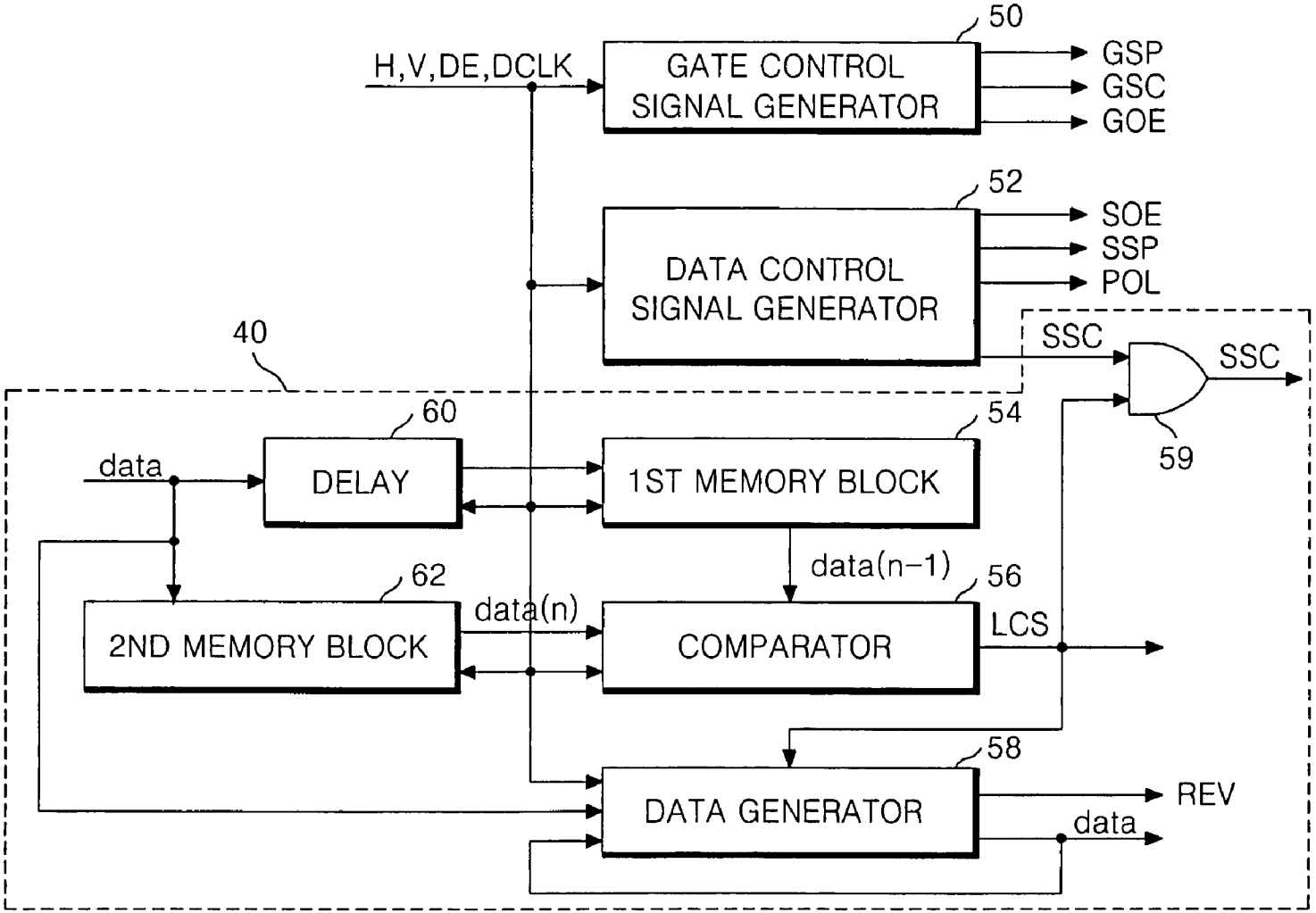
FIG. 5 is a detailed block diagram showing the timing controller of the driving apparatus shown in FIG. 4.

FIG. 5 is a detailed block diagram showing the timing controller of the driving apparatus shown in FIG. 4. As shown in FIG. 5, the timing controller 38 includes a gate control signal generator 50, a data control signal generator 52 and the encoding block 40. The gate control signal generator 50 generates the gate control signal GCS using the vertical/horizontal synchronizing signals V and H, the clock signal DCLK and the data enable signal DE. In particular, the gate control signal GCS may include a gate start pulse GSP, a gate shift clock GSC and a gate output enable signal GOE.

Similarly, the data control signal generator 52 generates the data control signal DCS using the vertical/horizontal synchronizing signals V and H, the clock signal DCLK and the data enable signal DE. The data control signal DCS may include a source start pulse SSP, a source shift clock SSC, a source output enable signal SOE and a polarity control signal POL, etc.

In addition, the encoding block 40 includes a delay block 60, a first memory block 54, a second memory block 62, a comparator 56 and a data generator 58. The data data supplied from the exterior source (not shown) to the encoding block 40 is received by the delay block 60. The delay block 60 delays the data data by a predetermined period of time corresponding to one horizontal line and applies the delayed data to the first memory block 54. The first memory block 54 then stores the delayed data data and applies a previous-line data data(n−1) for one previous line having been stored therein to the comparator 56. The data data supplied from the exterior source (not shown) to the encoding block 40 also is received by the second memory block 62. The second memory block 62 stores the data data for one line and applies a current-line data data(n) having been stored therein to the comparator 56.

The comparator 56 compares the previous-line data data (n−1) from the first memory block 54 with the current-line data data(n) from the second memory block 62. If it is determined that the previous-line data data(n−1) is identical to the current-line data data(n), then the comparator 56 enables the line control signal LCS and applies the enabled line control signal LCS to an AND gate 59 and the data generator 58. On the other hand, if it is determined that the previous-line data data(n−1) is different from the current-line data data(n), then the comparator 56 disables the line control signal LCS and applied the disabled line control signal LCS to the AND gate 59 and the data generator 58.

As a result, when a pixel data for the previous line is identical to a pixel data for the current line, the encoding block 40 enables the line control signal LCS and does not supply a data and the source shift clock SSC. On the other hand, when a pixel data for the previous line is not identical to a pixel data for the current line, the encoding block 40 disables the line control signal LCS and compares the previous pixel data with the current pixel data to invert and non-invert the current pixel data. Thus, a bit transition amount of the pixel data is minimized before being applied to the data driver 34.

The data generator 58 compares bit transition states of the current pixel data and the previous pixel data inputted when the disabled line control signal LCS is applied thereto. On the other hand, when the enabled line control signal LCS is inputted, the data generator 58 does not output the data data.

More specifically, when the disabled line control signal LCS is inputted, the data generator 58 compares each bit of the next pixel data with each bit of the current pixel data to detect a bit transition amount such as "0→1" or "1→0", and makes an inverted or non-inverted output of the data in correspondence with the detected bit transition amount. For instance, the data generator 58 may count bit transition amounts of the current pixel data and the previous pixel data, and checks whether or not the counted bit transition amounts exceed a critical value. The critical value may be set to be a half of the bit size of the data, e.g., 9 for an 18-bit data. Further, the data generator 58 inverts a logical value of the mode control signal REV and inverts the next pixel data to be supplied whenever the data transition amount exceeds the critical value, and then outputs them.

Moreover, the AND gate 59 applies the source shift clock SSC inputted thereto to the data driver 34 when the disabled line control signal LCS is inputted. On the other hand, the AND gate 59 does not apply the source shift clock SSC inputted thereto to the data driver 34 when the enabled line control signal LCS is inputted.

A detailed operation procedure of the encoding block 40 will be described. First, the comparator 56 determines whether or not the previous-line data data(n−1) from the first memory block 54 is identical to the current-line data data(n) from the second memory block 62. If it is determined that the previous-line data data(n−1) is identical to the current-line data data(n), then the comparator 56 enables the line control signal LCS and outputs the enabled line control signal LCS. In particular, the line control signal LCS may remain at an enable state during a time when a data for one line is supplied. Otherwise, if it is determined that the previous-line data data(n−1) is not identical to the current-line data data(n), then the comparator 56 disables the line control signal LCS and outputs the disabled line control signal LCS.

The data generator 58 does not apply a data for one line to the data driver 34 when the enabled line control signal LCS is supplied thereto. Also, the AND gate 59 does not apply the source shift clock SSC for one line to the data driver 34 when the enabled line control signal LCS is supplied thereto. Thus, when the previous-line data data(n−1) is identical to the current-line data data(n), a data for one line is not outputted and the source shift clock SSC is not applied to the data driver 34. Accordingly, a bit transition amount is not generated during a time corresponding to one line, thereby minimizing the EMI. Particularly, since the source shift clock SSC having a high frequency is not outputted, the EMI is effectively reduced.

On the other hand, when the disabled line control signal LCS is supplied, the data generator 58 checks whether or not the number of bit transitions of the previous pixel data and the current pixel data exceeds the critical value. If the number of bit transitions exceeds the critical value, then the data generator 58 inverts the current pixel data and applies the inverted current pixel data to the data driver 34. The data generator 58 also inverts the mode control signal REV before outputting it to the data driver 34. On the other hand, if the number of bit transitions does not exceed the critical value, then the data generator 58 applies the current pixel data to the data driver 34 as-is, keeps the mode control signal REV at the current state, and outputs the mode control signal REV to the data driver 34 as-is.

Figure 6:
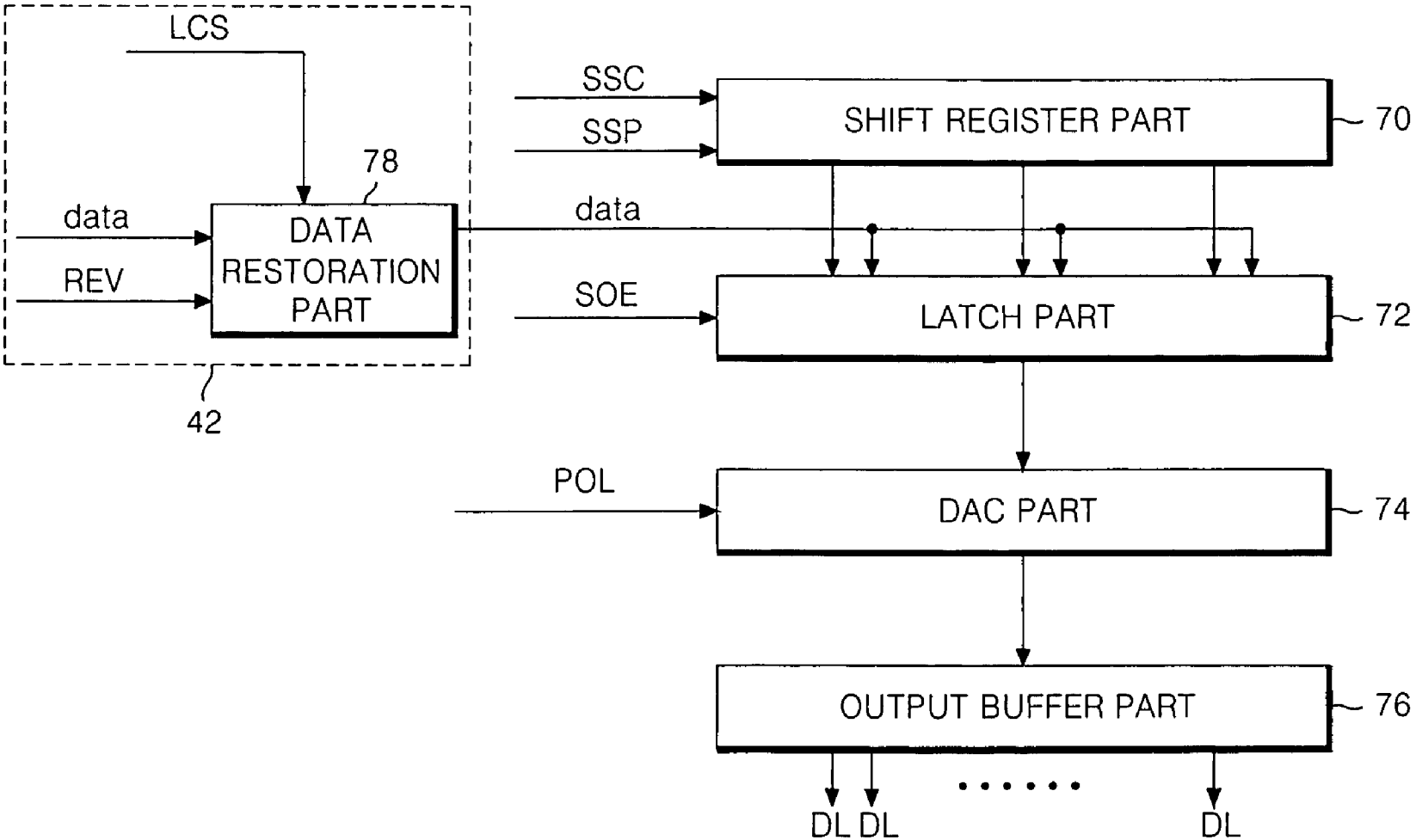
FIG. 6 is a block diagram showing a data integrated circuit according to an embodiment of the present invention.

FIG. 6 is a block diagram showing a data integrated circuit according to an embodiment of the present invention. As shown in FIG. 6, each of the data ICs of the data driver 34 (shown in FIG. 4) includes the decoding block 42, a data restoration part 78, a shift register part 70, a latch part 72, a digital to analog converter (DAC) part 74 and an output buffer part 76. The decoding block 42 determines whether or not a data data is to be supplied in response to the line control signal LCS, and determines whether or not the data data is to be inverted in response to the mode control signal REV. In particular, the data restoration part 78 does not supply the data data, irrespectively of the mode control signal REV and the data data, when the enabled line control signal LCS is inputted thereto. Thus, a data is not supplied from the data restoration part 78 to the latch part 72 during a time when the enabled line control signal LCS is inputted, i.e., during the time when a data for one line is supplied.

When the disabled line control signal LCS is inputted to the decoding block 42, the data restoration part 78 inverts or non-inverts a data data in response to the mode control signal REV. In particular, the data restoration part 78 inverts a data supplied thereto and applies the inverted data to the latch part 72 when the mode control signal REV has been inverted. The data restoration part 78 does not invert a data supplied thereto and applies the non-inverted data to the latch part 72 when the mode control signal REV has not been inverted.

In addition, when the enabled line control signal LCS is supplied to the data restoration part 78, the source shift clock SSC is not applied to the shift register part 70. Thus, a sampling signal is not applied to the latch part 72 during a time when the enabled line control signal LCS is supplied.

Further, a data is not supplied from the data restoration part 78 to the latch part 72 during a time when the enabled line control signal LCS is supplied. Thus, the latch part 72 keeps the previous data as it was when the enabled line control signal LCS is inputted. As a result, the latch part 72 applies a data having been kept therein to the DAC part 74 when the source output enable signal SOE is supplied. The DAC part 74 then converts a data supplied from the latch part 72 into positive and/or negative data signals in response to the polarity control signal POL to apply them to the output buffer part 76. Subsequently, the output buffer part 76 buffers such converted data from the DAC part 74 and applies the buffered data to the data lines DL.

Accordingly, in an embodiment of the present invention, when the enabled line control signal LCS is inputted, that is, when a data for the previous line is identical to a data for the current line, the data for the current line is generated using the data for the previous line having been stored in the latch part 72.

On the other hand, if the disabled line control signal LCS is inputted, then the shift register part 70 shifts the source start pulse SSP in response to the source shift clock SSC to generate a sampling signal, and applies the generated sampling signal to the latch part 72. The latch part 72 latches the inverted or non-inverted data supplied from the data restoration part 78 in response to the sampling signal.

As a result, the latch part 72 applies the stored data to the DAC part 74 when the source output enable signal SOE is inputted. The DAC part 74 converts the data supplied from the latch part 72 into positive and/or negative data signals in response to the polarity control signal POL and applies such converted data to the output buffer part 76. Subsequently, the output buffer part 76 buffers the converted data and applies the buffered data to the data lines DL.

As described above, according to an embodiment of the present invention, a data for the previous line is compared with a data for the current line by a timing controller before the data is applied to a data driver. If the data for the previous line is identical to the data for the current line, the data and the source shift clock are not applied from the timing controller to the data driver. Accordingly, signal transmission is reduced and the EMI is effectively minimized.

It will be apparent to those skilled in the art that various modifications and variations can be made in the apparatus and the method for driving a liquid crystal display device of the present invention without departing from the sprit or scope of the invention. Thus, it is intended that the present invention covers the modifications and variations of this invention provided they come within the scope of the appended claims and their equivalents.

What is claimed is:

1. A driving apparatus for a liquid crystal display device having a plurality of data lines, comprising:

a data integrated circuit;

a timing controller connected to the data integrated circuit;

an encoder provided at the timing controller, the encoder determining whether a data for a current line is identical to a data for a previous line and generating a line control signal based on the determination whether the current line data is identical to the previous line data; and a decoder provided at the data integrated circuit, the decoder receiving the line control signal from the encoder, wherein the encoder does not output the current line data during a predetermined period for the current line if the line control signal is in a first state indicating that the current line data is identical to the previous line data; and modifies and outputs a pixel data of the current line in response to a mode control signal according to a bit transition amount between the pixel data of the current line and a pixel data of the previous line if the line control signal is in a second state indicating that the current line data is not identical to the previous line data, and wherein the decoder does not output corresponding data during the predetermined period if the line control signal is in the first state, decodes and outputs the current pixel data from the encoder in response to the mode control signal if the line control signal is in the second state.

2. The driving apparatus according to claim 1, wherein the encoder comprises a comparator comparing each bit of the current line data with a corresponding bit of the previous line data to determine whether the current line data is identical to the previous line data.

3. The driving apparatus according to claim 2, wherein the encoder includes:

a first memory block outputting the previous line data to the comparator; and a second memory block outputting the current line data to the comparator.

4. The driving apparatus according to claim 3, wherein the encoder further includes a delay delaying a data signal by a predetermined period of time corresponding to one horizontal line and applying the delayed data to the first memory block.

5. The driving apparatus according to claim 1, wherein the encoder includes a data generator comparing the current pixel data with the previous pixel data to generate the mode control signal and selectively inverting the current pixel data in response to the mode control signal.

6. The driving apparatus according to claim 5, wherein the data generator does not compare the current pixel data with the previous pixel data when the current line data is determined to be identical to the previous line data.

7. The driving apparatus according to claim 5, wherein the data generator counts the bit transition amount between the current pixel data and the previous pixel data.

8. The driving apparatus according to claim 5, wherein the data generator inverts the polarity of the mode control signal when the current pixel data is inverted and maintains the polarity of the mode control signal when the current pixel data is not inverted.

9. The driving apparatus according to claim 1, wherein the encoder includes an AND gate having a first terminal for receiving a source shift clock from the timing controller, a second terminal for receiving the line control signal and an output terminal connected to the data integrated circuit.

10. The driving apparatus according to claim 9, wherein the AND gate does not output the source shift clock when the current line data is determined to be identical to the previous line data.

11. A method of driving a liquid crystal display device having a plurality of data lines, comprising:

determining whether a data for a current horizontal line is identical to a data for a previous horizontal line; and preventing a data signal and a source shift clock from being applied from a timing controller to a data driver, when the current line data is determined to be identical to the previous line data.

12. The method according to claim 11, further comprising generating data signals to be supplied to the data lines at the data driver using data applied previously to the data driver, when the data signal and the source shift clock are not applied to the data driver.

13. The method according to claim 11, further comprising generating a line control signal to be applied to the data driver, the line control signal being at an enabled state when the current line data is determined to be identical to the previous line data.

14. The method according to claim 13, wherein the enable line control signal is generated for a predetermine period of time corresponding to a period of time for data be applied to one horizontal line of the liquid crystal display panel device.

15. The method according to claim 11, further comprising counting a bit transition amount between a current pixel data and a previous pixel data and selectively inverting the current pixel data in response to the counted bit transition amount when the current line data is determined to be not identical to the previous line data.

16. The method according to claim 15, further comprising generating a mode control signal in response to the counted bit transition amount.

* * * * *